United States Patent [19]

Wendel

[11] 4,161,214

[45] Jul. 17, 1979

[54] LAUNDRY HOT WATER SUPPLY COIL ASSEMBLY

[75] Inventor: Ion L. Wendel, St. Petersburg, Fla.

[73] Assignee: James L. Lowe, St. Petersburg, Fla.

[21] Appl. No.: 932,435

[22] Filed: Aug. 10, 1978

Related U.S. Application Data

[63] Continuation of Ser. No. 740,301, Nov. 9, 1976, abandoned, which is a continuation-in-part of Ser. No. 660,323, Feb. 23, 1976, and Ser. No. 732,488, Oct. 14, 1976.

[51] Int. Cl.[2] ..... F28F 1/42

[52] U.S. Cl. ..... 165/172; 34/86; 34/90; 165/179; 165/184

[58] Field of Search ..... 165/163, 172, 130, 177, 165/178, 179, 184; 34/86

[56] References Cited

U.S. PATENT DOCUMENTS

| | | | |
|---|---|---|---|
| 1,697,600 | 1/1929 | Jack | 165/172 |
| 1,821,995 | 9/1931 | Wayman | 165/172 |
| 2,073,092 | 3/1937 | Bergholm | 165/179 |
| 2,279,548 | 4/1942 | Bailey | 165/179 |
| 2,644,675 | 7/1953 | Kopp | 165/163 |
| 3,050,867 | 8/1962 | Friedman | 34/86 |
| 3,217,799 | 11/1965 | Rodgers | 165/179 |
| 3,481,394 | 12/1969 | Withers, Jr. | 165/179 |
| 3,616,849 | 11/1971 | Dijt | 165/172 |
| 3,768,291 | 10/1973 | Rieger | 165/179 |
| 3,771,238 | 11/1973 | Vaughn | 34/86 |

FOREIGN PATENT DOCUMENTS

| | | | |
|---|---|---|---|
| 170712 | 7/1934 | Switzerland | 165/172 |

*Primary Examiner*—Sheldon Jay Richter
*Attorney, Agent, or Firm*—William E. Mouzavires

[57] ABSTRACT

A laundry dryer source of heat for providing warm gas to dry laundry is utilized to heat water for laundry washer use, and is particularly suited for coin operated laundries. Each dryer has a gas burner and a heat absorbtion water coil in the flame area of the burner, the coils being connected in a circuit between a cool water outlet and a heated water inlet of a typical automatic water heater tank, with pump means for circulating cool water from the tank through coils and returning heated water from the coils to the tank whenever any of the dryers are in operation. In one embodiment continuous water flow through the coils is provided during heating operation by substantially equal pressure differentials between the cold water inlet and the hot water outlet of each of the coils, and is further assured by provision of coils having substantially straight, horizontal runs, alternate runs being generally coplanar with the planes spaced apart. Preferably the coil has a continuous spiral groove along its inner face and a companion fin along its outer face.

5 Claims, 4 Drawing Figures

LAUNDRY HOT WATER SUPPLY COIL ASSEMBLY

This is a continuation, of application Ser. No. 740,301, filed Nov. 9, 1976, now abandoned the entire disclosure of which is incorporated herein by reference, which application is a continuation-in-part of my copending patent applications Ser. No. 660,323, filed Feb. 23, 1976, and Ser. No. 732,488, filed Oct. 14, 1976.

This invention relates to hot water supply coil assemblies and, more particularly, to such coil assemblies for providing heated water for laundry washers by utilizing a laundry dryer heat source.

BACKGROUND OF THE INVENTION

During low or normal capacity washer usage the automatic water heater provides adequate hot water for the washers in a laundry, but upon continuous heavy usage of the washers the water heater may prove to be inadequate and as a result the washers will be provided with lukewarm if not cold water. In typical coin operated laundries, one dryer is usually provided for two washers, with about ninety-five percent of the washed laundry generally beind dried in the dryers. A system for preheating water for the automatic water heater is shown in a recently issued patent, U.S. Pat. No. 3,771,238, in which a portion of the cold water normally supplied to the water heater is preheated by passing it through coils exposed to the warm vent gases recirculated through the dryer. However, since the vent gas temperature is relatively low, this patented system can do no more than preheat water for the automatic water heater, it cannot heat the water to normal water supply temperatures. Additionally, this system is controlled responsive to water temperature in the automatic water heater rather than responsive to operation of one or more of the dryers. Among the references cited in the previously noted patent is U.S. Pat. No. 3,050,867, which is quite similar but uses water heating coils in the individual vent flues of the dryers, and this system is controlled responsive to flue gas temperature rather than to the temperature of water in an automatic water heater as in the other patent. Another citation in the first noted patent is U.S. Pat. No. 1,731,290, which uses waste heat of a laundry environment for heating water. Other patents include U.S. Pat. No. 3,173,767, directed to a steam heated clothes dryer, and shows steam coils in an upper portion of the dryer for warming drying air which is circulated through the remainder of the dryer. U.S. Pat. No. 2,564,798 has separate compartments for washing, sterilizing, and drying dishes, and has burners for heating water coils, the exhaust of the burners being passed through a large conduit over which drying air is heated.

SUMMARY OF THE INVENTION

The invention, in brief, is directed to a hot water coil assembly positioned proximate laundry dryers burners which heat laundry drying gas circulated to the drying chamber of the associated dryer for drying the laundry. The coil is positioned in the combustion area of the burner aid, more particularly, in the flame area of the burner. The coil preferably has generally horizontal spaced apart runs interconnected in series by returns with alternate runs collectively coplanar and the planes spaced from each other. Preferably, a spiral groove is provided along the inner face of the coil and a complementary fin along the outer face.

It is an object of this invention to provide a new and useful hot water supply coil assembly.

A further object is provision of a new and useful heat absorption coil assembly which effectively prevents vapor locks in the coil.

Still another object is provision of new and useful laundry hot water supply coil assembly which may be easily and economically installed in existing laundries.

A more specific object is provision of a laundry hot water supply coil assembly including a conduit having an inlet and an outlet interconnected by a plurality of spaced apart generally straight runs and returns connecting the runs in series, alternate ones of the runs collectively defining sets of runs, the runs of each set being substantially coplanar, and the planes being generally parallel and spaced from each other. Related objects include provision of a substantially continuous spiral groove extending along the inner face of the conduit, and provision of a substantially continuous spiral protrusion extending along the outer surface of the conduit and defining a fin coextensive with and complementary to the groove. Still another related object is provision of the coil assembly in the form of a heat absorbing coil assembly and provision for passing a fluid to be heated through the coil from the inlet to the outlet and for applying heat to the outside of the coil to heat the fluid.

These and other objects and advantages of the invention will be apparent from the following description and the accompanying drawings.

DESCRIPTION OF THE ILLUSTRATED EMBODIMENT

Figure 1:
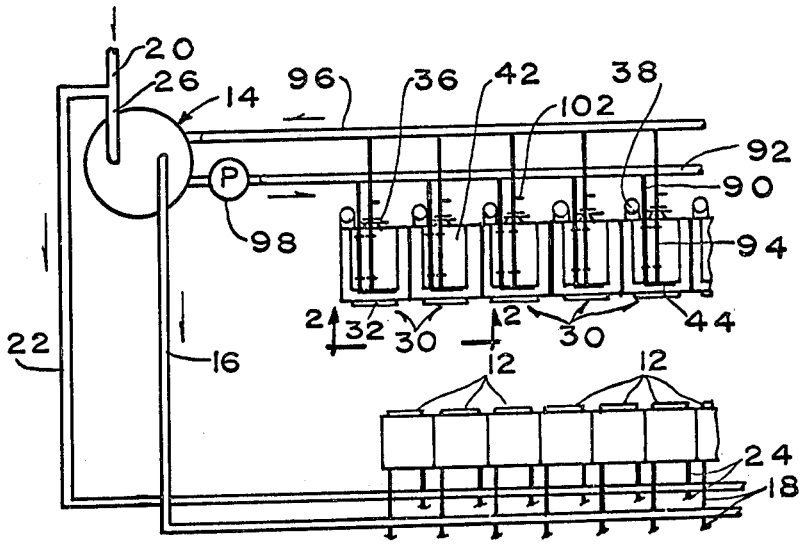
FIG. 1 is a schematic, fragmentary plan view of a portion of a coin operated laundry.

FIG. 1 of the drawing schematically illustrates a portion of a typical coin operated laundry having a plurality of coin operated washers 12 which receive hot water from an automatic water heater 14, including a storage tank, by means of a hot water supply pipe 16 connected through branch pipes 18 with the washers 12. The washers 12 are provided with cold water from a main supply pipe 20 through a cold water supply pipe 22 connected by branches 24 with the washers 12. The main supply pipe 20 also supplies the water heater 14 with cold water through pipe 26.

Figure 2:
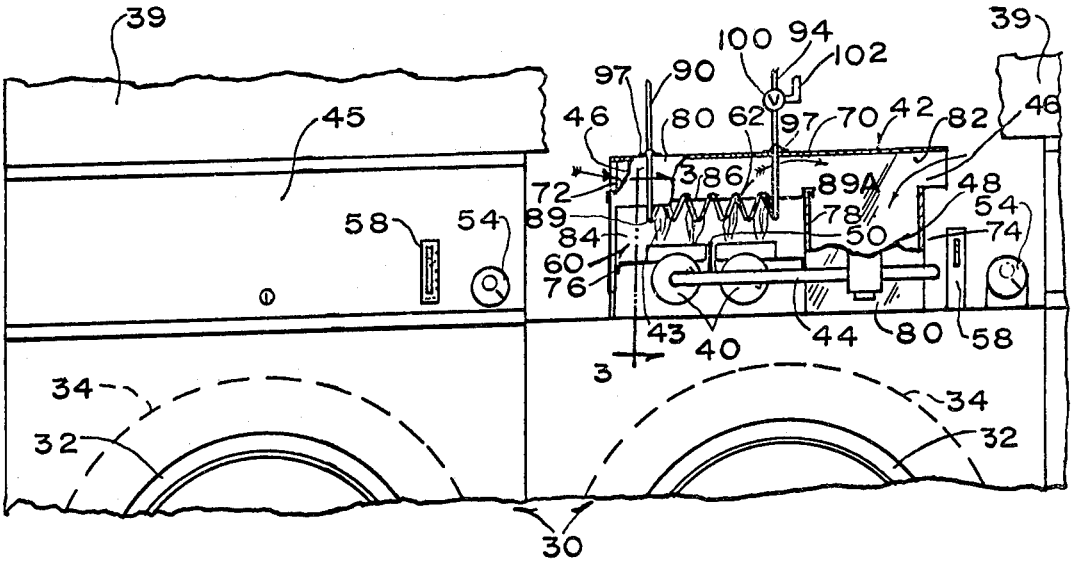
FIG. 2 is an enlarged, fragmentary, schematic elevational view of laundry dryers, as indicated generally by the line 2—2 in FIG. 1, with a top panel of one of the dryers removed to show the heating portion of the dryer, and with parts broken away and removed for clearer illustration.

With continuing reference to FIG. 1, a plurality of typical laundry dryers 30, such as a Huebsch dryer, Model 37A, each have the usual door 32 for insertion and removal of laundry from a perforated cylinder 34 or chamber (dashed lines, FIG. 2). During drying operation the cylinder 34 is rotated in typical manner by a suitable electric motor and drive assembly 36 on the rear of the dryer and this assembly also operates an exhaust blower (not shown) in the bottom portion of the dryer to exhaust the drying gas through a suitable vent or flue 38, the vents usually being connected with an exhaust duct (not shown).

Figure 3:
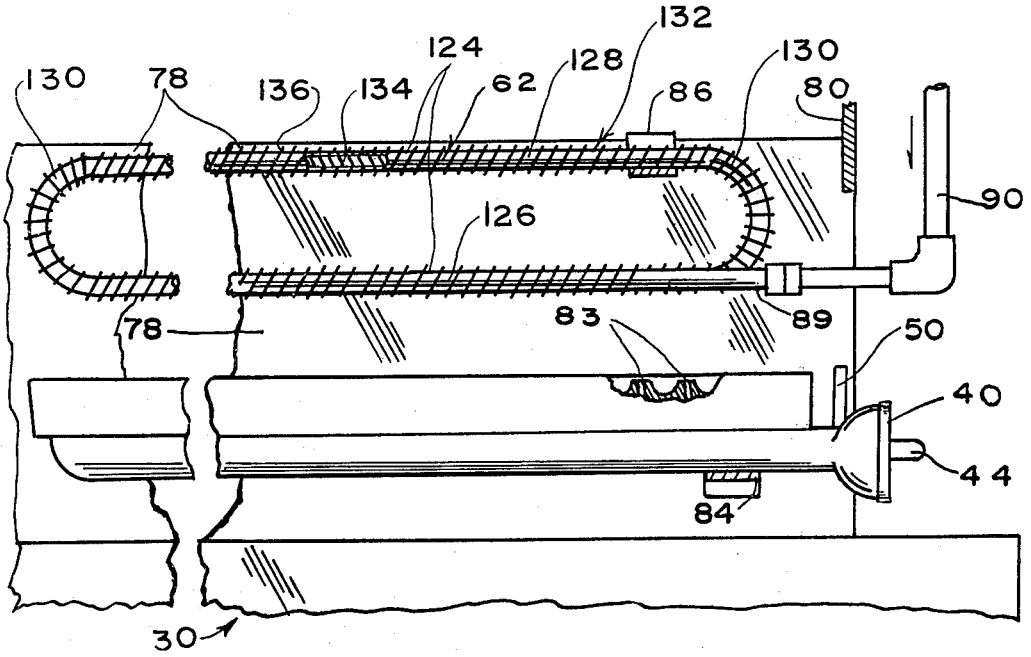
FIG. 3 is an enlarged, fragmentary, schematic, sectional elevational view taken generally along the line 3—3 in FIG. 2, with parts broken away and removed for clearer illustration.

With reference to FIGS. 2 and 3 a partition 39 is usually provided atop the front of the row of dryers 30 to conceal the piping, as 90–96. The upper portion of each dryer is provided with a drying system including a heater, usually of the combustion type, such as a gas burner unit 40 within a casing 42. Each burner unit 40 provides a combustion area 43, including a flame area, of relatively intense heat. Each burner unit 40 has the usual burner supply line and controls 44, and is concealed by a removable panel 45. The casing 42 provides opposed inlets 46 for air which mixes with the hot gases developed by the burner flames, the resultant warm gas passing downwardly through a duct 48 (FIG. 2) opening toward the laundry chamber 34.

With continuing reference to FIG. 2, a coin meter 54, upon insertion of a coin and turning of an actuator knob, initiates operation of a timer to provide a predetermined period of drying for each coin inserted and causes the motor drive assembly 36 to be turned on and gas to be provided through the supply line 44 to the burner unit 40 which is ignited by a pilot light 56 between the burners. The dryer 30 also has a temperature selection lever 58.

As illustrated in FIGS. 2 and 3, the hot water supply system comprises water heating apparatus 60 including the burner unit 40 and a water holder such as a coil 62 positioned immediately above the burner unit 40 in the flame area thereof and well upstream of the cylinder 34 relative to the flow of warm gas from the burner unit 40 through the duct 48.

The casing 42 includes a top wall 70 connected by suitable supports 72 with opposite side walls 74 and 76, with the air inlets 46 between each side wall and the top wall 70. The side wall 74, along with a center wall 78, define sides of the duct 48, and a front wall 80 and a rear wall 82 of the casing 42 provide front and rear closures of the duct 48.

Burner unit 40 is supported by cross members 84 secured to the side wall 76 and the center wall 78, and the coil 62 is supported by cross members 86 receiving upper tube runs of the coil and having inverted U-shaped ends seated on the top edge of the side wall 76 and the center wall 78. The bottom tube runs of the coil 62 are preferably about two inches above the burner gas orfices 83, and the front of the coil 62 is spaced rearwardly of the pilot 56 so that the water in the coil is not overheated by the pilot flame, thus avoiding the possibility of the water being appreciably heated when it is not circulating through the coils. If desired, the coil can be exposed to the pilot flame when water is being circulated 24 hours a day, to provide hot water during shutdown of the system as at night. With 10 dryers, the 10 pilot flames will heat the water in a 100 gallon storage tank from approximately 100° F. to 125° F. in approximately 10 hours. In a Huebsch Model 37A dryer, approximately eighteen feet of copper tubing of one-half or three-quarter inch inside diameter is formed into five convolutions with the coil being approximately sixteen inches long, nine inches wide, and approximately two and one-half inches high so that it may be installed through the burner access opening in the front wall 80 of the casing 42.

As may be noted best in FIGS. 2 and 3, a water circulating system is provided as follows: The front of each coil 62 has an inlet 89 and an outlet 89A (FIG. 2), the inlet connected with a cool water branch pipe 90 from a conduit defined by a cool water supply header or pipe 92 (FIG. 1) and the outlet connected with a heated water branch pipe 94 to a conduit defined by a heated water return header or pipe 96 (FIG. 1). Branch pipes 90 and 94 may be seated on the casing top 70 to receive heat from the top and may be secured to the top by pipe straps 97 (FIG. 2). The pipes 92 and 96 are preferably connected into the bottom portion of the storage tank of the automatic water heater 14, and a motor driven pump 98 is provided in the cool water supply pipe 92 to circulate the water and is operated by a suitable control system (not shown) when any of the dryers 30 are turned on by insertion of a coin and operation of the actuator knob of the coin-meter 54. Pressure relief valves 100 (FIG. 2) are preferably provided in each of the heated water branches 94 and preferably open into the drain lines 102.

Figure 4:
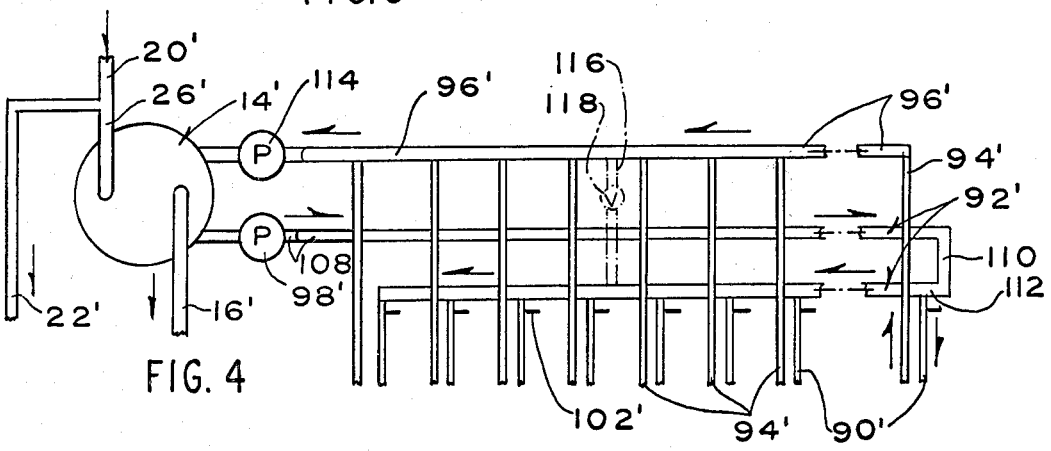
FIG. 4 is a schematic fragmentary plan view similar to a portion of FIG. 1 but illustrating a preferred embodiment of a water circulating system.

With reference to the embodiment of FIG. 4, reference numerals primed, as 92', refer to the same or similar parts as those indicated by the same unprimed reference numerals in the embodiment of FIGS. 1–3, and will not necessarily be again described. In FIG. 4 a water circulating system comprises the cool water supply pipe 92' including a pipe 108 extending from the water heater 14' to a return portion 110 past the dryer farthest from the water heater 14', and then has a header 112 which returns along the series of dryers for connection with the cool water branch pipes 90' to each of the coils and terminates at the last branch pipe 90'. The heated water return header or pipe 96' is connected to the heated water branch pipes 94' from the coils as in the prior embodiment. In this water circulating system, the cool water in the cool water header 112 and the heated water in the heated water header 96' flows in the same direction in the areas to which the branch pipes 90' and 94' are connected so that the pressure differential between the inlets and outlets of each of the coils is substantially the same, assuring substantially the same rate of water flow through each of the coils and effectively eliminating a lack of water in any of the coils which might result in burning out of that coil.

A water circulating pump 98' is shown in FIG. 4 in the cool water supply pipe 92', as in the prior embodiment, and a second water circulating pump 114 is also provided in the heated water return header 96'. While two pumps, as 98' and 114, are preferred in order to provide a push-pull effect on the water being circulated and assure more positive circulation of the water and steam which might be present, a single pump may be provided in the system in only the heated water return header 96' as shown by the pump 114. A pump having a capacity of one gallon per minute per coil is adequate but under some circumstances it may be desirable to provide a pump with much greater capacity, for example, eight gallons per minute per coil in which event a far greater quantity of water is circulated per minute through the coils with the heated water returning to the water heater 14' at a lower temperature. These pump capacities, as well as the use of a single pump in either the supply pipe 92' or return header 96', or a separate pump in each, is equally applicable to the embodiment of FIGS. 1–3.

In FIG. 4 the pressure relief valves (100 not shown) are connected with the drain lines 102' in the cool water branch pipes 90' rather than in the heated water branch pipes 94' of each of the coils 62'. If the heated water temperature from the coils is desired at a higher temperature, it is preferable to provide the relief valves in the cool water branch pipes 90' in order to avoid possible overheating of these valves.

Increase in the delivered temperature of the heated water may be provided by a cross-over connection 116, as shown by phantom lines in FIG. 4, between the header 112 of the cool water supply pipe 92' and the heated water return header 96'. The cross-over connection 116 is intermediate the series of dryers 30' so that a portion of the heated water in the return header 96' may be by-passed into the header 112 of the cool water supply pipe 92', whereupon the dryer coils 62' downstream of the cross-over connection receive cool water at a substantially elevated temperature over that normally provided and the temperature of the water delivered to the heated water branch pipes 94' is therefore at a substantially higher temperature before passing into the heated water header 96'. The cross-over connection 116 is provided with a regulating valve 118, and a plurality of cross-over connections, as 116, may be spaced along the headers, as required.

A preferred embodiment of coil 62 is shown in FIGS. 2 and 3 and is preferably of half or three-quarter inch inside diameter conduit such as copper tubing in a dryer as previously discussed. The coil has substantially straight runs 124, alternate ones of the runs collectively being in substantially coplanar sets. The runs of each set are spaced apart approximately two inches and the planes of the set are substantially horizontal with a lower one of the sets 126 being spaced from an upper one of the sets 128 a distance of about two inches. The runs 124 are interconnected by returns 130 which are preferably semi-circular and of a radius of about one inch, the runs being connected in series between the inlet 89 and the outlet 89A. In previously mentioned laundry dryer the overall length of the coil 62 between the outsides of the returns 130 is approximately eighteen inches.

The conduit has a continuous spiral 132 formed by a groove 134 along the inner surface of the conduit; and a co-extensive, complementary protrusion 136 extending outwardly from the outside of the coil conduit to define a continuous spiral fin. The spiral extends between opposite end portions of the coil at the inlet 89 and the outlet 89A, these end portions being devoid of spiral configuration to facilitate attachment of suitable inlet and outlet connectors. The spiral groove 134 facilitates smoother movement of the water or other fluid through the coil, and the fins 136 increase heat transfer from the gas about the coil to the fluid within the coil.

In a heat absorbing coil of this nature, air or vapor locks are effectively prevented so that the fluid moves continuously through the coil when the coil is heated by the burner gas. Numerous coil configurations such as spiral coils, flat coils in which the conduit is all in one plane, and numerous other configurations work well in immersion type coils in which a hot fluid is passed through the coil for heating a fluid about the coil, but these configurations are prone to causing vapor locks when the fluid within the coil is heated from an outside source of heat about the coil, such vapor locks substantially retarding, if not stopping, flow of the fluid within the coil and often resulting in the coil being burned out.

In the previously mentioned commercial dryer, each gas burner unit 40 develops approximately 142,000 BTU per hour and will develop heated water to a temperature of at least 130° F. With cool water in the bottom of an 80 gallon tank of water heater 14 at 60° F. and with only one dryer 30 in the system, and the heater of the automatic water heater 14 off, in three minutes the water temperature in the heated water return pipe 96 rose to 68° F., after thirty minutes of operation to 138° F. and after forty minutes of operation to 142° F., with no hot water being withdrawn through the hot water supply pipe 16. Thus, by positioning the coil 62 closely proximate the burner units 40, water may be heated to adequate temperature for washing purposes. Any suitable flow rate of the pump 98 may be provided to keep the water circulating during dryer operation.

Since most coin operated laundries have two washers 12 for each dryer 30, during extended peak periods the hot water supply system of this invention assures a continual supply of hot water to the washers, and in the event of a sudden peak load, rather than the normal gradual peaking, the hot water heater 14 is usually able to supply adequate hot water until the laundry loads are transferred from the washers to the dryers, whereupon the dryers provide ample hot water for continued laundry operations.

While this invention has been described and illustrated with reference to particular embodiments in a particular environment, various changes may be apparent to one skilled in the art and the invention is therefore not to be limited to such embodiments or environment, except as set forth in the appended claims.

What is claimed is:

1. For use in a laundry dryer and clothes washer combination; a coil for liquid such as water to be inserted in the heating unit of a dryer to derive heat therefrom to heat water flowing through the coil; the coil comprising, fluid inlet and outlet ports interconnected by a plurality of generally straight and spaced apart runs, each run having opposite ends interconnected by returns connecting said runs in series with each other between said inlet and said outlet ports, said runs including upper and lower sets of runs, the runs of each set lying generally in a common plane with the other runs of the set and the planes of the two sets of runs being generally parallel and spaced from each other; said runs having formed internally throughout the length thereof a continuous spiral groove for conveying liquid such as water through the coil, and wherein said runs are formed from metallic tubing and wherein the outer surface of the runs are configured in a shape as a spiral protrusion complementary to the spiral groove of the runs and extending coextensively and continuously with the spiral groove in the same direction as the spiral groove.

2. The coil as defined in claim 1 wherein the distance between runs in each set is approximately two inches and the distance between each of the sets is approximately two inches.

3. The coil as defined in claim 2 wherein the length of each run is approximately eighteen inches.

4. The coil defined in claim 3 wherein said metallic tubing is formed from copper and has an inside diameter approximately one-half to three-quarters of an inch.

5. The coil defined in claim 1 wherein said spiral groove has generally the same axial pitch and spacing as said spiral protrusion.

* * * * *